US011581008B2

(12) United States Patent
Layton et al.

(10) Patent No.: US 11,581,008 B2
(45) Date of Patent: Feb. 14, 2023

(54) SYSTEMS AND METHODS FOR IMPROVING FUNCTIONAL HEARING

(71) Applicant: Quid Pro Consulting, LLC, Incline Village, NV (US)

(72) Inventors: Andrew Layton, Albany, CA (US); Kuo Tong, Incline Village, NV (US)

(73) Assignee: Quid Pro Consulting, LLC, Incline Village, NV (US)

( * ) Notice: Subject to any disclaimer, the term of this patent is extended or adjusted under 35 U.S.C. 154(b) by 0 days.

(21) Appl. No.: 17/486,585

(22) Filed: Sep. 27, 2021

(65) Prior Publication Data

US 2022/0246164 A1 Aug. 4, 2022

Related U.S. Application Data

(60) Provisional application No. 63/143,535, filed on Jan. 29, 2021.

(51) Int. Cl.

| | |
|---|---|
| ***G10L 21/10*** | (2013.01) |
| ***H04R 25/00*** | (2006.01) |
| *G10L 21/06* | (2013.01) |

(52) U.S. Cl.

CPC ..... *G10L 21/10* (2013.01); *H04R 25/505* (2013.01); *H04R 25/554* (2013.01); *H04R 25/604* (2013.01); *H04R 25/609* (2019.05); *G10L 2021/065* (2013.01); *H04R 2225/025* (2013.01); *H04R 2225/43* (2013.01)

(58) Field of Classification Search

CPC ..... G10L 21/10

See application file for complete search history.

(56) References Cited

U.S. PATENT DOCUMENTS

| | | | | |
|---|---|---|---|---|
| 10,791,404 | B1 * | 9/2020 | Lasky | G10L 25/27 |
| 2015/0088501 | A1 * | 3/2015 | Recker | G10L 21/10 704/235 |
| 2015/0230032 | A1 * | 8/2015 | Petersen | H04R 25/305 381/60 |

(Continued)

FOREIGN PATENT DOCUMENTS

| | | | |
|---|---|---|---|
| GB | 2579085 | A | 6/2020 |
| WO | WO 2022/010465 | A1 | 1/2022 |

OTHER PUBLICATIONS

International Search Report and Witten Opinion for International Application No. PCT/US2022/014531 dated May 6, 2022 (9 pages).

*Primary Examiner* — Mark Fischer

(74) *Attorney, Agent, or Firm* — Finnegan, Henderson, Farabow, Garrett & Dunner, LLP

(57) ABSTRACT

Embodiments of the present disclosure are directed to systems and methods for improving functional hearing. In one aspect, the system may include a housing configured to fit within an ear of a user. The housing may include a speaker, an amplifier, a transmitter, and a power supply. Additionally, the housing may include a memory storing instructions and at least one processor configured to execute instructions. The instructions may include receiving an audio input and amplifying the audio input. The instructions may include outputting the amplified audio input from a speaker. The instructions may include converting the audio input into a visual representation of the audio input and transmitting the visual representation to at least one display.

23 Claims, 6 Drawing Sheets

(56) References Cited

U.S. PATENT DOCUMENTS

| | | | | |
|---|---|---|---|---|
| 2017/0186431 | A1 | 6/2017 | Didik | |
| 2017/0287504 | A1* | 10/2017 | Vogel | A61N 1/36031 |
| 2018/0324535 | A1* | 11/2018 | Boesen | H04R 25/70 |
| 2020/0321007 | A1* | 10/2020 | Stoker | G10L 15/26 |

* cited by examiner

SYSTEMS AND METHODS FOR IMPROVING FUNCTIONAL HEARING

CROSS-REFERENCE TO RELATED APPLICATIONS

This application is based on and claims benefit of priority of U.S. Provisional Patent Application No. 63/143,535 filed Jan. 29, 2021, the contents of which is incorporated herein by reference in its entirety.

TECHNICAL FIELD

The present disclosure generally relates to systems and methods for improving the functional hearing of an individual. In particular, embodiments of the present disclosure relate to inventive and unconventional systems and methods for converting an audio input into a visual representation of the audio input.

BACKGROUND

Hearing aid devices have been used to help individuals with hearing loss or hearing impairment. A typical hearing aid system 100 is illustrated in FIG. 1. As illustrated in FIG. 1, an individual may speak and produce sounds, illustrated at 120. A hearing aid 130 may collect the sounds 120, amplify the sounds 120, and output the amplified sounds, illustrated at 140. A user 150 of a hearing aid is presented with amplified sounds 140.

While this is beneficial to many users, typical hearing aids 130 are not useful in all situations. For example, in a noisy environment, a typical hearing aid 130 may merely amplify all noise, making it hard for a user to distinguish spoken words from amplified background noise. Some hearing aid devices may attempt to "selectively" amplify noise (e.g., via the sound frequency), however, amplification alone does not improve speech recognition or provide any feedback loops to help a user retrain the brain and central nervous system (CNS) to recognize audio signals or retain functional speech recognition.

A need exists for a hearing aid system that is useful in situations where single person speech is not the only audio signal and that provides a visual representation of spoken words or other sounds.

SUMMARY

One aspect of the present disclosure is directed to a system for improving functional hearing. The system may include a housing configured to fit within an ear of a user. The housing may include a speaker, an amplifier, a transmitter, and a power supply. Additionally, the housing may include a memory storing instructions and at least one processor configured to execute instructions. The instructions may include receiving an audio input and amplifying the audio input. The instructions may include outputting the amplified audio input from a speaker. The instructions may include converting the audio input into a visual representation of the audio input and transmitting the visual representation to at least one display.

Another aspect of the present disclosure is directed to a method for improving functional hearing. The method may include receiving an audio input from a microphone positioned within a user's ear and amplifying the audio input. The method may include outputting the amplified audio input from a speaker within the user's ear. The method may include converting the audio input into a visual representation of the audio input and transmitting the visual representation to at least one display.

Yet another aspect of the present disclosure is directed to a system for improving functional hearing having a first housing configured to fit within an ear of a user. The housing may include a speaker, an amplifier, and a power supply. The system may include a second housing. The second housing may include a transmitter. The second housing may also include a memory storing instructions. At least one processor may be configured to execute the instructions to receive an audio input. At least one processor may be configured to execute the instructions to convert the audio input into a visual representation of the audio input. At least one processor may be configured to execute the instructions to transmit the visual representation to at least one display.

DETAILED DESCRIPTION

Figure 1:
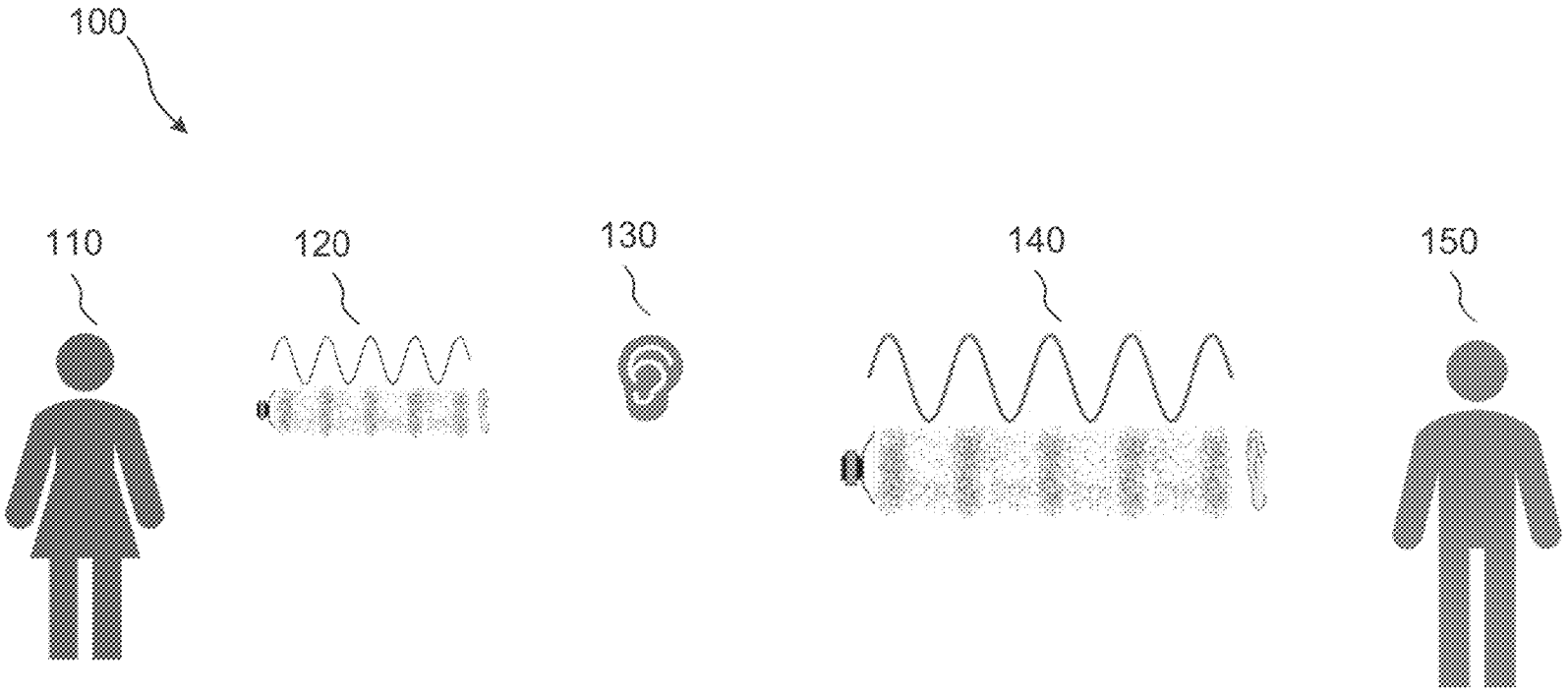
FIG. 1 PRIOR ART
FIG. 1 depicts a conventional hearing aid system.

The following detailed description refers to the accompanying drawings. While several illustrative embodiments are described herein, modifications, adaptations and other implementations are possible. For example, substitutions, additions, or modifications may be made to the components and steps illustrated in the drawings, and the illustrative methods described herein may be modified by substituting, reordering, removing, or adding steps to the disclosed methods. Accordingly, the following detailed description is not limited to the disclosed embodiments and examples. Instead, the proper scope of the invention is defined by the appended claims.

Embodiments of the present disclosure are directed to systems and methods for improving functional hearing, thus helping to improve speech recognition of an individual as well as allow an individual to retrain functional speech recognition.

Figure 2:
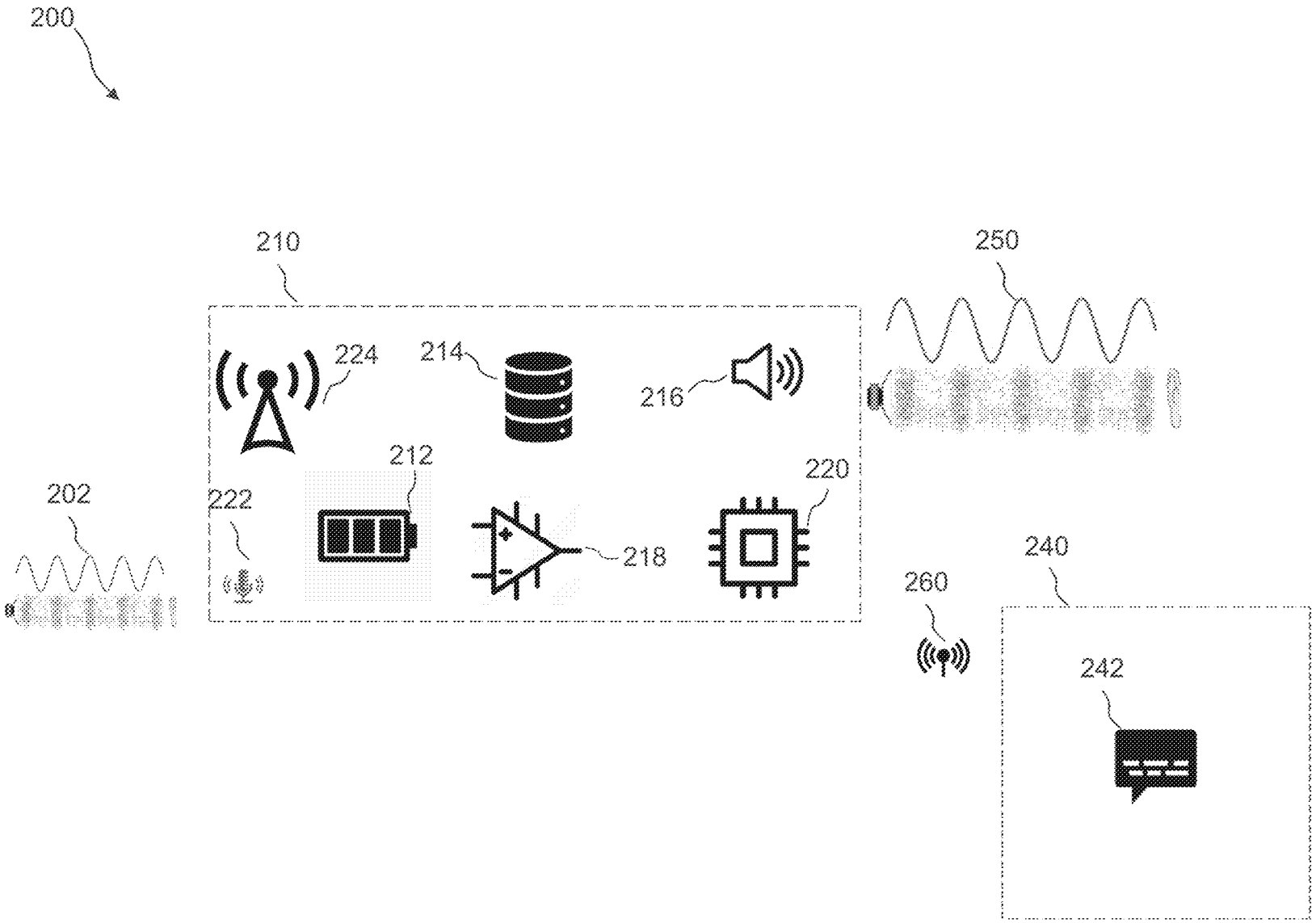
FIG. 2 illustrates an arrangement of a system in accordance with aspects of the present disclosure.

FIG. 2 illustrates an arrangement of a system 200 for improving functional hearing of an individual in accordance with aspects of the present disclosure. System 200 includes a housing 210 configured to fit within an ear of a user. The housing may be shaped and sized to fit completely or partially within the ear canal, and may be made of any appropriate biocompatible material. For example, the housing may be made of a plastic or polymeric material, such acrylic, methacrylate, silicone, polyvinyl chloride, polyethylene, or any other suitable polymer. Furthermore, the housing may include a natural or synthetic rubber material, a sponge material, or a metal. The housing may be rigid or soft, or include rigid portions and soft portions. The housing may be hermetically sealed to protect the contents from moisture and mechanical damage and be suitable for cleaning and sterilizing. Additionally, the housing may be formed in one piece or in multiple pieces configured to securely attach to one another.

Housing 210 may include electrical, mechanical, or electromechanical components. The components may be configured to receive an audio input, amplify the audio input, and output the amplified audio input. Additionally, the components may also be configured to convert the audio input into a visual representation of the audio input, and transmit the visual representation to at least one display 240. The components may be completely or partially contained within the housing.

A power supply 212 may be positioned partially or completely within housing 210 to supply power to the components. Power supply 212 may be a battery, a capacitor, a solar cell, or any device capable of supplying electricity to the components within housing 210. The power supply 212 may be disposable or rechargeable, and may convert chemical energy into electricity or otherwise supply electricity to components. For example, the power supply 212 may be a lithium-ion battery, zinc-air battery, button battery, or other battery having dimensions and shape suitable for use within housing 210. The power supply 212 may be rechargeable through a wired or wireless mechanism. For example, the power supply 212 may include a coil and be reachable by inductive charging.

A microphone 222 or other audio input device capable of converting sound waves into electrical energy or signals may be positioned partially or completely within housing 210. The microphone 222 may collect sound or audio input 202 from an individual's environment. The microphone 222 may include any type of transducer or other device capable of converting sound or audio input 202 into signals suitable for processing. Sound or audio input 202 may include any sound or sound wave capable of being collected or otherwise received by microphone 222. For example, sound or audio input 202 may include words or voices spoken, music received from a radio, background noise in a room, or any other noise or sound produced in any manner.

An amplifier 218 may be positioned partially or completely within housing 210 that receives the electrical energy or signals from the microphone 222 and increases the strength of the energy or signals. The amplifier 218 may increase the amplitude or intensity of the electrical energy or signals from the microphone 222 prior to the signals being output by a speaker 216.

Speaker 216 may be partially or completely enclosed within housing 210. The speaker 216 may output any amplified audio input. Speaker 216 may be a loudspeaker or any device that converts an electrical or other signal into a corresponding sound. Speaker 216 may be positioned within or partially within housing 210 in a manner to direct sound produced by the speaker 216 towards an individual's tympanic membrane. The sound output 250 may be magnitudes greater in intensity than the sound or audio input 202. Additionally or alternatively, audio input may be transferred through bone vibrations directly to the individual's cochlea, otherwise known as bone conduction. For example, an electromechanical transducer may be used to convert electric signals from the microphone 222 into mechanical vibrations and may send these mechanical vibrations to the internal ear through the cranial bones.

A transmitter or transceiver 224 may be positioned partially or completely within housing 210. The transmitter or transceiver 224 may wirelessly transmit data or information from housing 210 to a location remote from the housing 210. For example, transmitter 224 may send data or information to display 240 over a wired or wireless communication channel 260. Additionally, transmitter 224 may allow for communication with a remote server or servers for data or information processing. Transmitter 224 may include frequency receivers and transmitters and/or optical (e.g., infrared) receivers and transmitters. In some embodiments, transmitter 224 may operate over a wireless network such as a GSM network, a GPRS network, an EDGE network, a Wi-Fi or WiMAX network, or a Bluetooth® network. Transmitter or transceiver 224 may be configured to send and receive electrical, electromagnetic or optical signals that carry digital data streams representing various types of information.

The housing 210 may contain a memory 214 storing instructions. The memory 214 may include any type of physical memory on which information or data readable by at least one processor 220 can be stored. Examples include random access memory (RAM), read-only memory (ROM), volatile memory, nonvolatile memory, hard drives, CD ROMs, DVDs, flash drives, disks, any other optical data storage medium, any physical medium with patterns of holes, a RAM, a PROM, and EPROM, a FLASH-EPROM or any other flash memory, NVRAM, a cache, a register, any other memory chip or cartridge, and networked versions of the same. The term "memory" may refer to multiple structures, such as a plurality of memories or computer-readable storage mediums. Memory 214 may include a database or catalogue of information.

At least one processor 220 configured to control operations of the components and execute stored instructions may be positioned or partially positioned within housing 210. The at least one processor 220 may be configured to execute computer programs, applications, methods, processes, or other software to perform aspects described in the present disclosure. For example, the processor may include one or more integrated circuits, microchips, microcontrollers, microprocessors, all or part of a central processing unit (CPU), graphics processing unit (GPU), digital signal processor (DSP), field programmable gate array (FPGA), or other circuits suitable for executing instructions or performing logic operations. The at least one processor 220 may include at least one processor configured to perform functions of the disclosed methods such as a microprocessor manufactured by Intel™. The at least one processor 220 may include a single core or multiple core processors executing parallel processes simultaneously. In another example, the at least one processor 220 may include a multiple-core processor arrangement (e.g., dual, quad core, etc.) configured to provide parallel processing functionalities to allow a device associated with the at least one processor 220 to execute multiple processes simultaneously. It is appreciated that other types of processor arrangements could be implemented to provide the capabilities disclosed herein.

Figure 3:
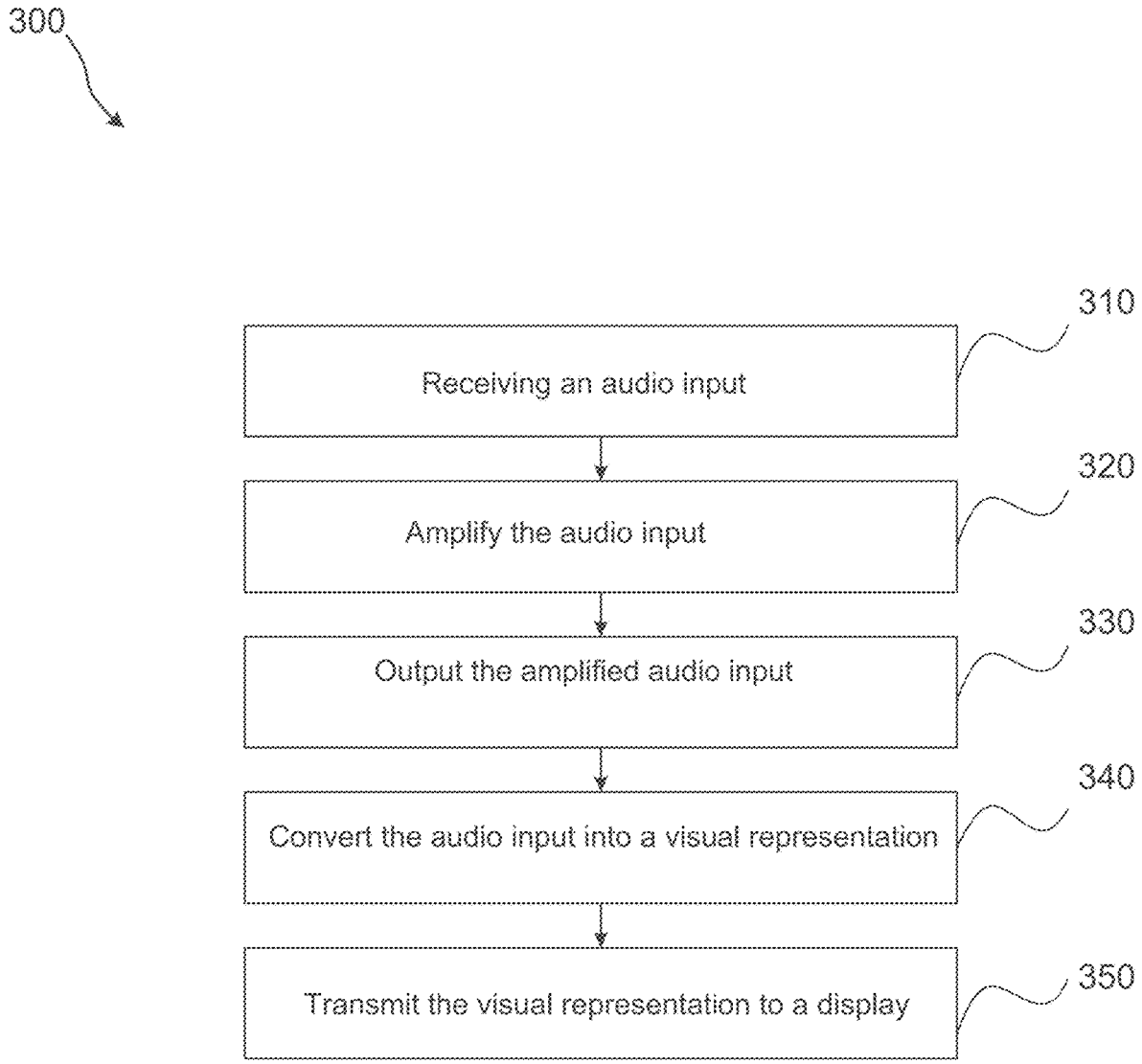
FIG. 3 illustrates a method for improving functional hearing in accordance with aspects of the present disclosure.

The at least one processor 220 may execute the instructions to perform method 300 shown in FIG. 3. At step 310 the instructions may direct the system 200 to receive an audio input. The audio input may be received by microphone 222. The instructions may direct the amplifier 218 to amplify the audio input at step 320. At step 330, the amplified audio input may be output from speaker 216. The audio input may be converted into a visual representation of the audio input at step 340. For example, the audio input may include speech or other verbal communication. In one aspect, the speech or other verbal communication may be filtered from background noise and broken down into small, individual bits of sounds or recognizable phonemes. Sophisticated audio analysis software or application may analyze the phonemes to determine spoken words. Algorithms may be used to find the most probable word fit by querying a database of known words, phrases, and sentences. Statistical modeling systems may use probability and other mathematical functions to determine a most likely outcome. For example, a Hidden Markov Model may be used to match a digital sound with a phenome that is most likely to follow in a spoken word or phrase. The at least one processor 220 may instruct the software or application to operate locally and utilize a local database associated with memory 214. However, the at least one processor 220 may instruct the software or application to communicate with one or more remote servers to perform the speech to text analysis to take advantage of more powerful processing capabilities. This may be performed via a direct connection to the Internet, or through a connection with a mobile communications device. At step 350, the at least one processor 220 may transmit the visual representation to at least one display. For example, as shown in FIG. 2, the at least one display 240 may include a SMS text message 242 showing the spoken words. In other aspects, the display 240 may present an image, video, or other illustration to provide a visual representation of the audio input. In some aspects, transmitting the visual representation to the at least one display may include transmitting over a wireless communication channel 260. While the steps have been shown performed in order, it is understood that the steps may be performed in a different order or concurrently. For example, the audio input may be converted into a visual representation prior to or concurrently with the amplified audio input being outputted by speaker 216.

In one aspect, the at least one display 240 may be part of a mobile communications device. The term "mobile communications device" may refer to any portable device with display or presentation capabilities that can communicate with a remote server over a wireless network or other network. Examples of mobile communications devices include, smartphones, tablets, smartwatches, smart glasses, wearable sensors and other wearable devices, wireless communication chipsets, user equipment (UE), personal digital assistants, laptop computers, and any other portable pieces of communications equipment.

In another aspect, the at least one display 240 may include a wearable form factor. The term "wearable form factor" may include any device capable of being worn by an individual and including a display or other output or notification system. For example, a wearable form factor may include smart glasses, a film, one or more LEDs, or an accessory. The at least one processor 220 may perform instructions to transmit the visual representation of the audio input to the wearable form factor. The visual representation may be displayed or otherwise output by the wearable form factor. In one aspect, a user wearing smart glasses may be presented with the text or words associated with speech or spoken words from another individual. Additionally, an image, video, or other representation of the speech or spoken words may be presented to the wearer of the glasses.

A film may be associated with any article of clothing or accessory. A film may include any type of thin flexible output device capable of being adhered or otherwise incorporated into a garment, accessory, or device wearable by a user. The film may display text or words associated with speech or spoken words, but may also display an image, video, or other representation of the speech or spoken words. The film may be arranged in such a manner as to be viewable by the wearer, but also may be arranged to be viewable by another individual. For example, a parent of a child with a hearing disorder may wear a shirt which has a film. The film may output text or words, an image, video, or other representation of speech or spoken words to allow the child to see words spoken by the parent while at a distance from the parent. Machine learning methods or appropriate algorithms may be used by processor 220 to determine whether to output text or words, an image, video, or other representations of speech or spoken words based on a given audio or speech input.

One or more LEDs may be arranged in a manner to flash in patterns or in specific colors to indicate a visual representation of an audio input. For example, speech or spoken words may be displayed using Morse Code or another lexicon or language based on signals. In addition to LEDs, any type of light bulb or light generating device may be used to create patterns associated with a visual representation of an audio input.

Figure 4:
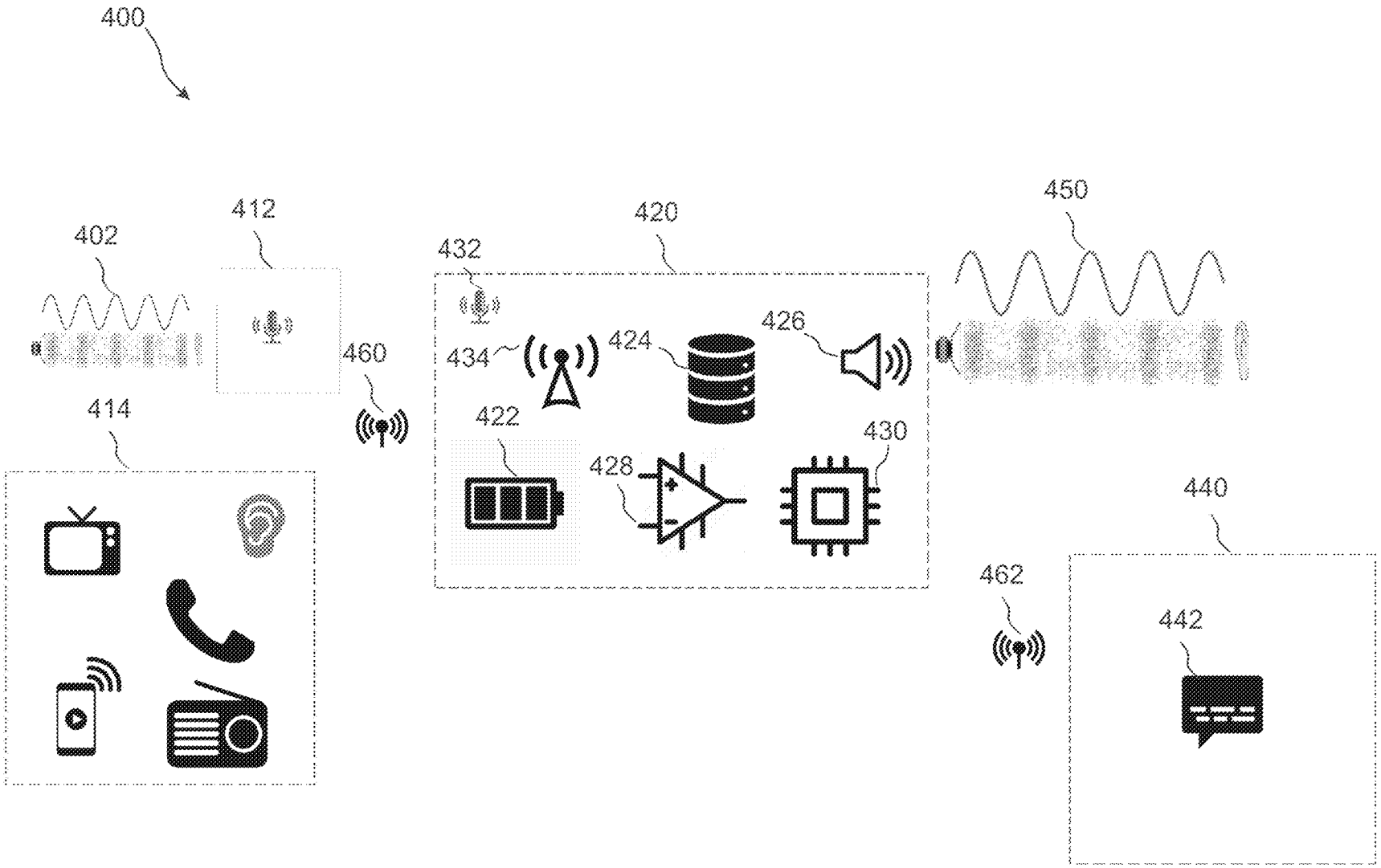
FIG. 4 illustrates an arrangement of a system in accordance with aspects of the present disclosure.

FIG. 4 illustrates an arrangement of a system 400 for improving functional hearing of an individual in accordance with aspects of the present disclosure. System 400 includes a housing 420 configured to fit within an ear of a user. The housing may be shaped and sized to fit completely or partially within the ear canal, and may be made of any appropriate biocompatible material as previously discussed. Similar to housing 210 discussed above, housing 420 may include a microphone 432, memory 424, speaker 426, power supply 422, amplifier 428, at least one processor 430, and transmitter or transceiver 434. In addition, housing 420 may include other components such as an A/D converter and various IC boards to perform the functions associated with elements of the present disclosure.

System 400 may include a remote microphone 412. Remote microphone 412 may be any audio input device positioned apart from housing 420 and capable of receiving sound or sound waves and converting the sound waves to electrical signals. Remote microphone 412 may be standalone or integrated into another device. For example, remote microphone 412 may be part of a mobile communications device. Remote microphone may receive an audio input 402, convert the audio input into one or more electrical or digital signals, and transmit the signals to housing 420 for further processing. The signals may be transmitted over any wired or wireless communication channel 460. Remote microphone 412 may include a transmitter or transceiver. The transmitter or transceiver may include frequency receivers and transmitters and/or optical (e.g., infrared) receivers and transmitters. In some embodiments, transmitter 224 may operate over wireless network such as a GSM network, a GPRS network, an EDGE network, a Wi-Fi or WiMAX network, and a Bluetooth® network. The transmitter or transceiver may be configured to send and receive electrical, electromagnetic or optical signals that carry digital data streams representing various types of information.

Additionally, system 400 may include a device 414. The processor 430 may be configured to execute instructions to receive an audio input from the device 414. The device 414 may include any device that produces a sound or sound output capable of being converted into a visual representation. For example, the device 414 may output speech or spoken words that may be converted to a text or written output capable of being read by an individual. In another example, notes from music may be translated into a visual representation including a tablature, a score sheet, or a graph or chart showing the rise and fall of the notes. The device 414 may, for example, include at least one microphone, radio, TV, computer, cd player, tape player, cellular phone, smart phone, phone, PDA, musical equipment, game console, hearing aid, or streaming device. The device 414 may also include one or more transmitters or transceivers to transmit data or information over wired or wireless network 460, including a raw sound output, to housing 420. In order to reduce the amount of processing required within housing 420, sound produced by the device 414 may be filtered or otherwise processed prior to transmitting to housing 420. By performing processing of data outside of housing 420, component sizes may be kept to a minimum to allow for housing 420 to easily fit within a user's ear.

The at least one processor 430 may execute the instructions to perform method 300 shown in FIG. 3. At step 310 an audio input may be received. The audio input may be received by microphone 432 contained partially or completely within housing. Additionally, the audio input 402 may be received from remote microphone 412 or from device 414. Microphone 432 may receive an output from device 414, or an audio output from device 414 may be directly sent from device 414 and received by a separate processing component within housing 420. In this manner, an audio input may be received from device 414 even if microphone 432 is unable to receive an input because of being too far away from the source. The instructions may direct the amplifier 428 to amplify the audio input at step 320. At step 330, the amplified audio input may be output from speaker 426. The audio output 450 may be magnitudes greater than the audio input 402. Additionally or alternatively, audio input may be transferred through bone vibrations directly to the individual's cochlea, otherwise known as bone conduction. For example, an electromechanical transducer may be used to convert electric signals from remote microphone 412, device 414, or microphone 432 into mechanical vibrations and may send these mechanical vibrations to the internal ear through the cranial bones.

The audio input may be converted into a visual representation of the audio input at step 340. For example, the audio input may include speech or other verbal communication. In one aspect, the speech or other verbal communication may be filtered from background noise and broken down into small, individual bits of sounds or recognizable phonemes. Sophisticated audio analysis software or application may analyze the phonemes to determine spoken words. Algorithms may be used to find the most probable word fit by querying a database of known words phrases, and sentences. Statistical modeling systems may use probability and other mathematical functions to determine a most likely outcome. For example, a Hidden Markov Model may be used to match a digital sound with a phenome that is most likely to follow in a spoken word or phrase. The word or phrase may then be selected for display. In another example, music received from device 414 may be converted into a visual representation. The at least one processor 430 may instruct the software or application to operate locally and utilize a local database associated with memory 424. However, the at least one processor 430 may instruct the software or application to communicate with one or more remote servers to perform the speech to text analysis to take advantage of more powerful processing capabilities. This may be performed via a direct connection to the internet, or through a connection with a mobile communications device. At step 350, the at least one processor 430 may transmit the visual representation to at least one display over a wireless communication network 462. For example, as shown in FIG. 4, the at least one display 440 may include a SMS text message 442 showing the spoken words. In other aspects, the display 440 may present an image, video, hologram, light wave, or other illustration to provide a visual representation of the audio input. For example, audio music may be represented as a series of flashing lights, or as a series of notes on a musical score sheet. While the steps in FIG. 3 have been shown performed in order, it is understood that the steps may be performed in a different order or concurrently. For example, the audio input may be converted into a visual representation prior to or concurrently with the amplified audio input being outputted by speaker 426.

In one aspect, the at least one display 440 may be part of a mobile communications device. As previously discussed, the term "mobile communications device" refers to any portable device with display or presentation capabilities that can communicate with a remote server over a wireless network or other network. Examples of mobile communications devices include, smartphones, tablets, smartwatches, smart glasses, wearable sensors and other wearable devices, wireless communication chipsets, user equipment (UE), personal digital assistants, laptop computers, and any other portable pieces of communications equipment.

In another aspect, the at least one display 440 may include a wearable form factor. As previously discussed, the term "wearable form factor" may include any device capable of being worn by an individual and includes a display or other output or notification system. For example, a wearable form factor may include smart glasses, a film, one or more LEDs, or an accessory. The at least one processor 430 may perform instructions to transmit the visual representation of the audio input to the wearable form factor. The visual representation may be displayed or otherwise output by the wearable form factor. In one aspect, a user wearing smart glasses may be presented with the text or words associated with speech or spoken words from another individual. Additionally, an image, video, or other representation of the speech or spoken words may be presented to the wearer of the glasses.

A film may be associated with any article of clothing or accessory. A film may include any type of thin flexible output device capable of being adhered or otherwise incorporated into a garment, accessory, or device wearable by a user, as previously discussed. The film may display text or words associated with speech or spoken words, but may also display an image, video, or other representation of the speech or spoken words. The film may be arranged in such a manner as to be viewable by the wearer, but also may be arranged to be viewable by another individual. For example, a parent of a child with a hearing disorder may wear a shirt which has a film. The film may output text or words, an image, video, or other representation of speech or spoken words to allow the child to see words spoken by the parent while at a distance from the parent. Machine learning methods or appropriate algorithms may be used by processor 430 to determine whether to output text or words, an image, video, or other representation of speech or spoken words based on a given audio or speech input.

One or more LEDs may be arranged in a manner to flash in patterns or in specific colors to indicate a visual representation of an audio input. For example, speech or spoken words may be displayed using Morse Code. In addition to LEDs, any type of light bulb or light generating device may be used to create patters associated with a visual representation of an audio input.

Figure 5:
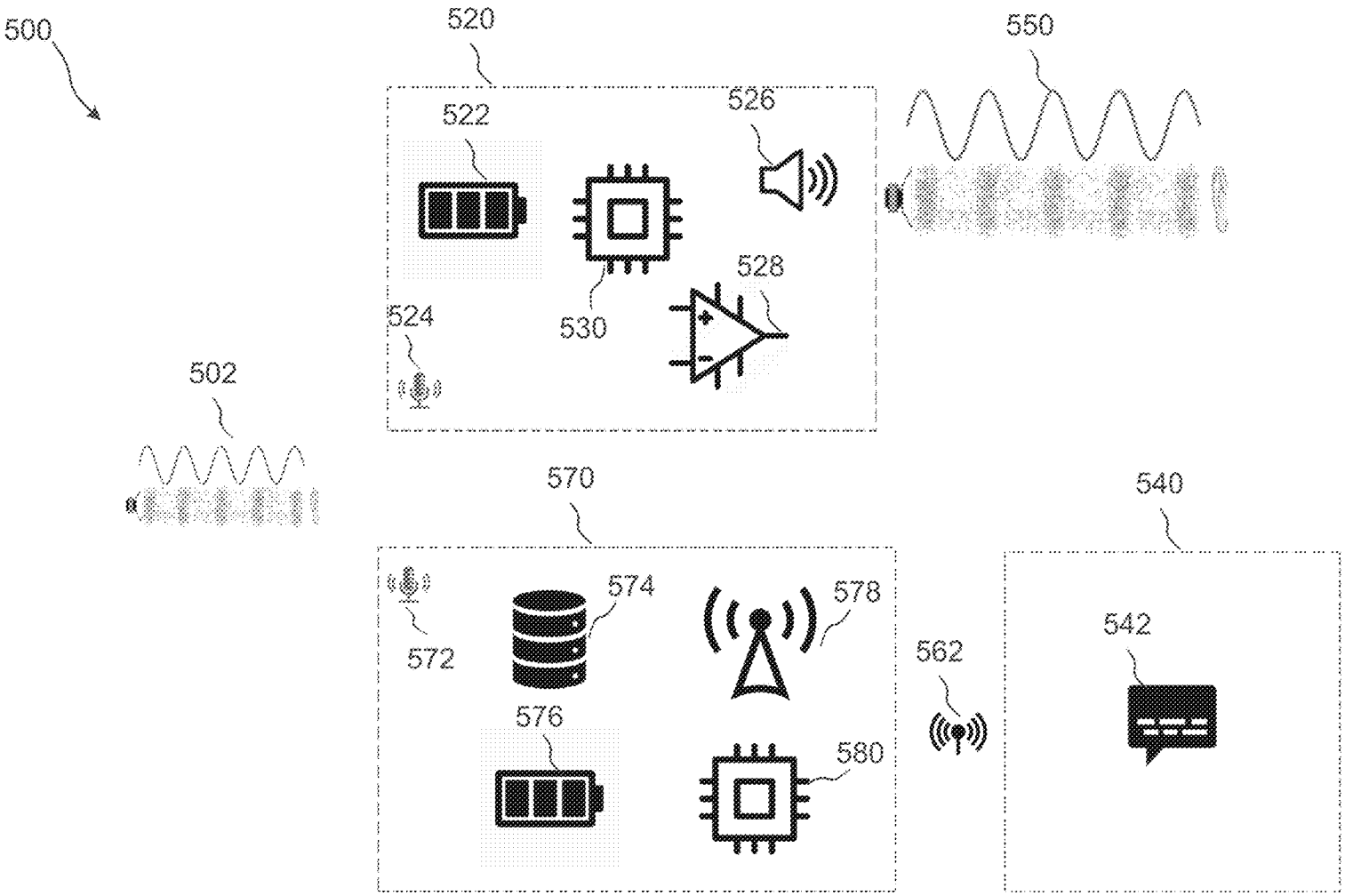
FIG. 5 illustrates an arrangement of a system in accordance with aspects of the present disclosure.

FIG. 5 illustrates an arrangement of a system 500 for improving functional hearing of an individual in accordance with aspects of the present disclosure. System 500 includes a first housing 520 configured to fit within an ear of a user. The housing may be shaped and sized to fit completely or partially within the ear canal, and may be made of any appropriate biocompatible material as previously discussed. Housing 520 may include a first microphone 524, speaker 526, power supply 522, memory 527, at least one processor 530, and amplifier 528. In addition, housing 520 may include other components such as an A/D converter and various IC boards to perform the functions associated with elements of the present disclosure.

System 500 may additionally include a second housing 570 remote from the first housing. The second housing may be formed of any desired material and be configured to keep the components in the housing free from moisture and dust. Second housing 570 may include partially or completely therein a transmitter or transceiver 578, a power supply 576, a second microphone 572, at least one processor 580, and a memory 574 storing instructions. In addition, housing 570 may include other components such as an A/D converter and various IC boards to perform the functions associated with elements of the present disclosure.

The at least one processor 530 in the first housing 520 may execute instructions to receive an audio input 502 from first microphone 524, amplify the audio input, and output the amplified audio input from speaker 526 towards a user's tympanic membrane. The amplified audio input may be output, illustrated at 550, at several magnitudes greater than the received audio input 502. Additionally or alternatively, audio input may be transferred through bone vibrations directly to the individual's cochlea, otherwise known as bone conduction. For example, an electromechanical transducer may be used to convert electric signals from first microphone 524, a separate device, or second microphone 572 into mechanical vibrations and may send these mechanical vibrations to the internal ear through the cranial bones.

The at least one processor 580 associated with the second housing may execute instructions to perform portions of method 300 shown in FIG. 3. At step 310 the instructions may receive an audio input. The audio input may be received by second microphone 572 contained partially or completely within housing 570. Additionally, the audio input 502 may be received from a separate device (not shown). The device may include any device that produces a sound or sound output capable of being converted into a visual representation. For example, the device may output speech or spoken words that may be converted to a text or written output capable of being read by an individual. In another example, notes from music may be translated into a visual representation including a tablature, a score sheet, or a graph or chart showing the rise and fall of the notes. The device may, for example, include at least one microphone, radio, TV, computer, cd player, tape player, cellular phone, smart phone, phone, PDA, musical equipment, game console, hearing aid, or streaming device. The device may also include one or more transmitters or transceivers to transmit data or information over wired or wireless network 560, including a raw sound output, to housing 570. Second microphone 572 may receive an output from the device, or an audio output from the device may be directly sent from the device and received by a separate processing component within housing 570. In this manner, an audio input may be received from the device even if second microphone 572 is unable to receive an input because of being too far away from the source. In order to reduce the amount of processing required within housing 570, sound produced by the device may be filtered or otherwise processed prior to transmitting to housing 570.

The audio input may be converted into a visual representation of the audio input at step 340. For example, the audio input may include speech or other verbal communication received by second microphone 572 or a separate device. In one aspect, the speech or other verbal communication may be filtered from background noise and broken down into small, individual bits of sounds or recognizable phonemes. Sophisticated audio analysis software or applications may analyze the phonemes to determine spoken words. Algorithms may be used to find the most probable word fit by querying a database of known words, phrases, and sentences. Statistical modeling systems may use probability and other mathematical functions to determine a most likely outcome. For example, a Hidden Markov Model may be used to match a digital sound with a phenome that is most likely to follow in a spoken word or phrase. The spoken word or phrase may then be selected for display. In another example, music received from a separate device may be converted into a visual representation. The at least one processor 580 may instruct the software or application to operate locally and utilize a local database associated with memory 524. However, the at least one processor 580 may instruct the software or application to communicate with one or more remote servers to perform the speech to text analysis to take advantage of more powerful processing capabilities. This may be performed via a direct connection to the internet, or through a connection with a mobile communications device. At step 350, the at least one processor 580 may transmit the visual representation to at least one display 540 over a wireless communication network 562. For example, as shown in FIG. 5, the at least one display 540 may include a SMS text message 542 showing the spoken words. In other aspects, the display 540 may present an image, video, hologram, light wave, or other illustration to provide a visual representation of the audio input. For example, audio music may be represented as a series of flashing lights, or as a series of notes on a musical score sheet.

In one aspect, the at least one display 540 may be part of a mobile communications device. The term "mobile communications device" may refer to any portable device with display or presentation capabilities that can communicate with a remote server over a wireless network or other network. Examples of mobile communications devices may include, smartphones, tablets, smartwatches, smart glasses, wearable sensors and other wearable devices, wireless communication chipsets, user equipment (UE), personal digital assistants, laptop computers, and any other portable pieces of communications equipment.

In another aspect, the at least one display 540 may include a wearable form factor. The term "wearable form factor" may include any device capable of being worn by an individual and includes a display or other output or notification system. For example, a wearable form factor may include smart glasses, a film, one or more LEDs, or an accessory. The at least one processor 580 may perform instructions to transmit the visual representation of the audio input to the wearable form factor. The visual representation may be displayed or otherwise output by the wearable form factor. In one aspect, a user wearing smart glasses may be presented with the text or words associated with speech or spoken words from another individual. Additionally, an image, video, or other representation of the speech or spoken words may be presented to the wearer of the glasses. Machine learning methods or appropriate algorithms may be used by processor 530 to determine whether to output text or words, an image, video, or other representation of speech or spoken words based on a given audio or speech input.

In one aspect, to improve the performance of systems 200, 400, and/or 500, one or more presenters may take part in a training regimen to calibrate or train the systems. The one or more presenters may include any individual verbally talking, speaking, lecturing, or presenting in an environment having at least one of systems 200, 400, and/or 500. For example, the one or more presenters may be a lecturer at a conference, a child at an amusement park, a teacher in a classroom, a wife or a husband at home, or any other situation in which one or more people may be speaking. A training regimen may include speaking or talking a plurality of words or phrases into one of microphones 222, 412, 432, 524, or 572 when prompted by one of displays 240, 440, or 540. In this manner, systems 200, 400, and/or 500 may account for differences in audio frequency, inflection, pronunciation, accent, and other variables associated with speech for various individuals. The training regimen may include displaying an initial set of words or phrases that include all of the perceptually distinct units of sound in a specified language that distinguish one word from another. For example, the training regimen may include a list of 100 words that encompass each of the 44 phonemes found in the English language. When a presenter completes the initial set, the presenter may be instructed to recite a second set or words or phrases. The second set of words or phrases may be provided to the presenter from a list, application, or some manner other than from one of displays 240, 440, or 540. As the presenter speaks or talks each word or phrase in the second set, systems 200, 400, and/or 500 may convert the word or phrase, using information gained during the initial set, and may display each word or phrase. The presenter may verify that the displayed word or phrase is correct before moving to the next word. If the systems 200, 400, and/or 500 produce a correct display and a desired accuracy is achieved, for example, more than 90%, the calibration is complete.

In another aspect, a user of at least one of systems 200, 400, and/or 500 may undergo a training regimen or calibration program. The user may be one or more individuals wearing a hearing aid associated with systems 200, 400, and/or 500 or viewing displays 240, 440, and/or 540. In this situation, one or more presenters, such as an audiologist helping to familiarize a user to systems 200, 400, and/or 500 may recite a list of predefined words or phrases while the user listens to the spoken words or phrases and observes displays 240, 440, and/or 540 for the visual representation of the words or phrases. After each spoken word or phrase, the user may indicate whether the text displayed of the word or phrase matches the user's perception of the word or phrase spoken by the one or more presenters. Systems 200, 400, and/or 500 may tally the number of correct responses to create an accuracy score reflective of the total number of correct responses. Systems 200, 400, and/or 500 may display the accuracy score or otherwise provide feedback to the user. In one aspect, an accuracy score may be determined as a percentile of correct responses from the total amount of predefined words or phrases presented. In this aspect, a desired accuracy score may be in the range of 90%-100%, greater than 95%, greater than 96%, greater than 97%, greater than 98%, greater than 99%, or any other appropriate range denoting a passing score for the user or the presenter. In another aspect, an accuracy score may reflect the total number of incorrect responses from the total amount of predefined words or phrases presented. In this aspect, an accuracy score may be in the range of 0%-10%, less than 5%, less than 4%, less than 3%, less than 2%, less than 1%, or any other appropriate range denoting a passing score for the user or the presenter. In another aspect, an accuracy score may be determined and displayed as a ratio. Systems 200, 400, and/or 500 may analyze the responses of the user to create additional training regimens or programs to improve speech recognition of the user as well to retrain functional speech recognition. For example, if systems 200, 400, and/or 500 determine that the user misheard words or phrases having certain sounds, phonemes, or other characteristics, systems 200, 400, and/or 500 may generate one or more additional sets of words or phrases highlighting those sounds, phonemes, or characteristics. In this manner, a user may retrain the brain and central nervous system (CNS) to recognize audio signals by correlating audio signals to the displayed words or phrases. The user may be able to flag systems 200, 400, and/or 500 when words or phrases perceived by the user are not consistent with a visual representation of the words or phrases. Systems 200, 400, and/or 500 may utilize any flagged words or phrases in creating addition training sets for the user. Systems 200, 400, and/or 500 may also record any audio input and store the input in memory for later use when a flag by the user is detected. In this manner, a user may review any misunderstood words or phrases at a later time. Additionally, if systems 200, 400, and/or 500 are unable to decipher or correlate an audio input to an appropriate visual representation, a signal may be sent to at least one display indicating as much. For example, at least one display may present a message of "unable to decipher." When this occurs, the correlating audio input may be stored in memory for later analysis.

Figure 6:
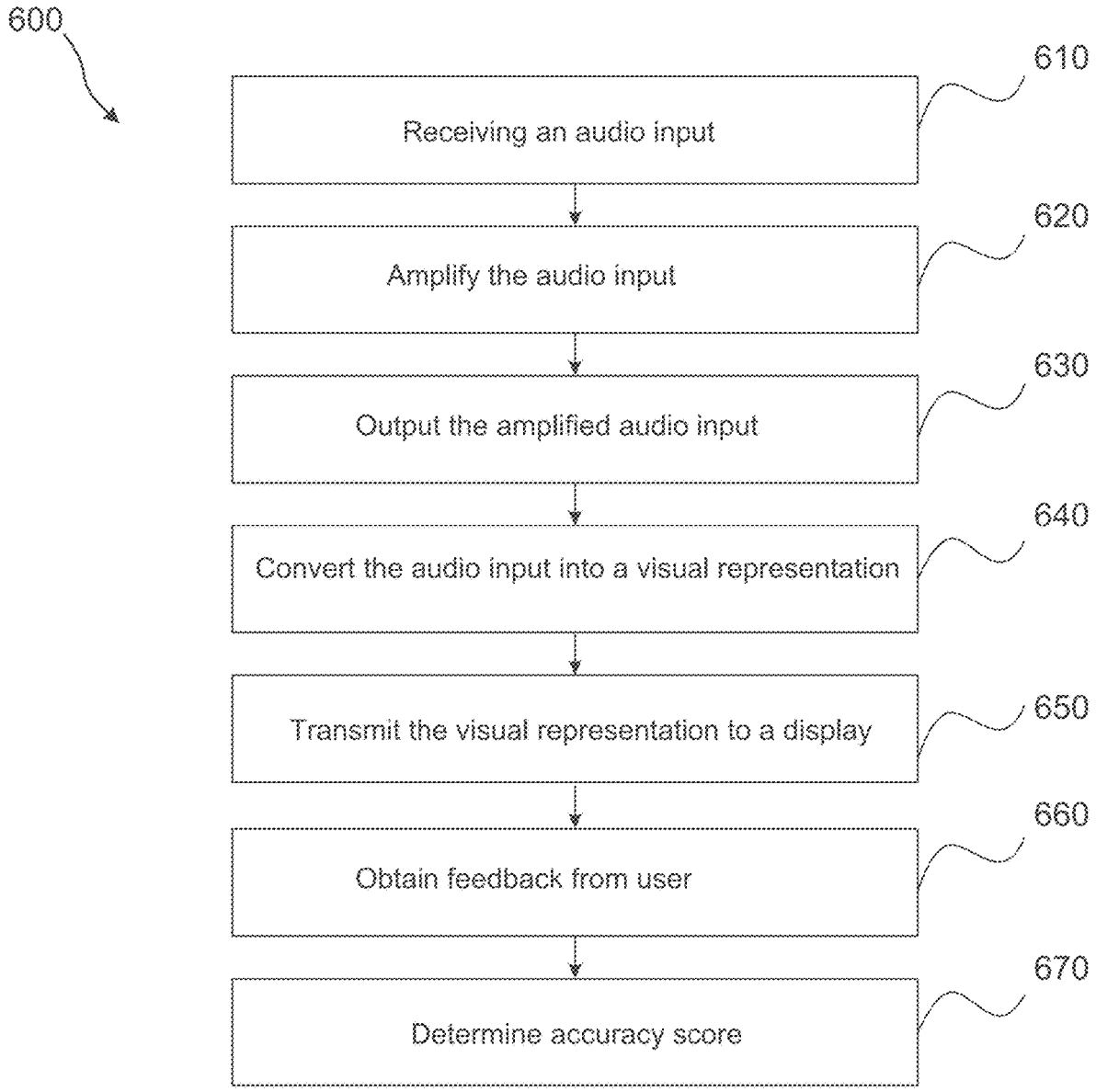
FIG. 6 illustrates a method for improving functional hearing in accordance with aspects of the present disclosure.

FIG. 6 illustrates a method 600 of improving functional hearing in accordance with another aspect of the disclosure. While method 600 will be described using system 200 as an example, method 600 may be performed at least with any of the systems set forth above and illustrated in FIG. 2, FIG. 4, and FIG. 5. Furthermore, some steps in method 600 may be performed with systems 200, 400, and/or 500, while some steps may be performed with a different processing device. To begin, an audio input is received at step 610. The audio input may be received by microphone 222. The instructions may direct the amplifier 218 to amplify the audio input at step 620. At step 630, the amplified audio input may be output from speaker 216. The audio input may be converted into a visual representation of the audio input at step 640. For example, the audio input may include speech or other verbal communication. In one aspect, the speech or other verbal communication may be filtered from background noise and broken down into small, individual bits of sounds or recognizable phonemes. Sophisticated audio analysis software or application may analyze the phonemes to determine spoken words. Algorithms may be used to find the most probable word fit by querying a database of known words phrases, and sentences. Statistical modeling systems may use probability and other mathematical functions to determine a most likely outcome. For example, a Hidden Markov Model may be used to match a digital sound with a phenome that is most likely to follow in a spoken word or phrase. The word or phrase may then be chosen for display. The same or different algorithms may be used to convert the audio input into a visual representation of the audio input. The at least one processor 220 may instruct the software or application to operate locally and utilize a local database associated with memory 214. However, the at least one processor 220 may instruct the software or application to communicate with one or more remote servers to perform the speech to text analysis to take advantage of more powerful processing capabilities. This may be performed via a direct connection to the Internet, or through a connection with a mobile communications device. At step 650, the at least one processor 220 may transmit the visual representation to at least one display. For example, as shown in FIG. 2, the at least one display 240 may include a SMS text message 242 showing the spoken words. In other aspects, the display 240 may present an image, video, or other illustration to provide a visual representation of the audio input. In some aspects, transmitting the visual representation to the at least one display includes transmitting over a wireless communication channel 260.

At step 660, feedback from the user may be obtained. The feedback may provide an indication of how well the user hears and understands an amplified audio input output by the speaker 216. For example, if the amplified audio input output by the speaker 216 sounds to the user like the word "hat", yet the visual display indicates the correct word is "that," the user can provide feedback indicating as much. The feedback may include typing the word the user perceived to be spoken. However, the user may provide feedback in any manner. For example, the user may provide feedback in the form of a selection or other touch response by selecting an object on a touch screen, pressing a button, or otherwise making a selection. Additionally, the feedback may be provided verbally by the user. In some cases, the user may provide feedback indicating that certain words, phrases, or parts of speech are exempt from accuracy determinations, for example, because words represent proper nouns or foreign language phrases, which are not priorities for speech recognition. In another aspect, sensors or other data gathering devices may be used to obtain feedback from a user. For example, EEG electrodes may be placed on a user's head to monitor brain waves concurrently with the presentation of the visual representation. Such feedback may be used to better train the system 200, as well as to retrain a user to improve functional hearing.

At step 670 an accuracy score may be determined by analyzing the feedback provided by the user. In one aspect, the accuracy score may be utilized to aid in training of the system. In another aspect, the accuracy score may be used as a guide while retraining a user's central nervous system. For example, a user having a low accuracy score at a first time and a higher accuracy score at a later time may indicate that the user has made progress, and has relearned certain spoken words or phrases previously unrecognized. An accuracy score may reflect the number of times a user's perception of a spoken word or phrase aligns with the word or phrase displayed.

While the steps have been shown performed in order, it is understood that the steps may be performed in a different order or concurrently. For example, the audio input may be converted into a visual representation prior to or concurrently with the amplified audio input being output by speaker 216.

While the present disclosure has been shown and described with reference to particular embodiments thereof, it will be understood that the present disclosure can be practiced, without modification, in other environments. For example, the system has been described as being used with a hearing aid positioned within a user's ear canal. However, the concept may equally be applied to over the ear hearing aid systems as well as implantable hearing aid systems. The foregoing description has been presented for purposes of illustration. It is not exhaustive and is not limited to the precise forms or embodiments disclosed. Modifications and adaptations will be apparent to those skilled in the art from consideration of the specification and practice of the disclosed embodiments. Additionally, although aspects of the disclosed embodiments are described as being stored in memory, one skilled in the art will appreciate that these aspects can also be stored on other types of computer readable media, such as secondary storage devices, for example, hard disks or CD ROM, or other forms of RAM or ROM, USB media, DVD, Blu-ray, or other optical drive media.

Computer programs based on the written description and disclosed methods are within the skill of an experienced developer. Various programs or program modules can be created using any of the techniques known to one skilled in the art or can be designed in connection with existing software. For example, program sections or program modules can be designed in or by means of .Net Framework, .Net Compact Framework (and related languages, such as Visual Basic, C, etc.), Java, C++, Objective-C, HTML, HTML/AJAX combinations, XML, or HTML with included Java applets.

Moreover, while illustrative embodiments have been described herein, the scope of any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application. The examples are to be construed as non-exclusive. Furthermore, the steps of the disclosed methods may be modified in any manner, including by reordering steps and/or inserting or deleting steps. It is intended, therefore, that the specification and examples be considered as illustrative only, with a true scope and spirit being indicated by the following claims and their full scope of equivalents.

What is claimed is:

1. A system for improving functional hearing, comprising:

a housing configured to fit within an ear of a user, the housing comprising:
- a speaker,
- an amplifier,
- a transmitter, and
- a power supply;

a memory storing instructions;

at least one processor configured to execute instructions to:
- receive an audio input,
- amplify the audio input,
- output the amplified audio input from the speaker,
- convert the audio input into a visual representation of the audio input, and
- transmit the visual representation to at least one display;

at least one first training regimen configured to be used by a presenter to calibrate a visual representation system; and at least one second training regimen configured to be used by the user to recognize audio signals by correlating audio signals to the visual representation;

wherein the first training regimen comprises:
- displaying an initial set of words or phrases;
- prompting the presenter to make an audio input corresponding to the initial set of words or phrases;
- recording and analyzing variables including one or more of inflection, pronunciation, and accent from the presenter created audio input;
- providing a second set of words or phrases;
- converting an audio input corresponding to each word or phrase of the second set to a visual representation based on variables recorded and analyzed from the initial set;
- transmitting the visual representation to at least one display;

prompting the presenter to verify the accuracy of the visual representation of each word or phrase; and correcting the visual representation if a desired accuracy is not achieved.

2. The system for improving functional hearing according to claim 1, wherein the at least one display comprises a mobile communications device.

3. The system for improving functional hearing according to claim 1, wherein the at least one display comprises a wearable form factor.

4. The system for improving functional hearing according to claim 3, wherein the wearable form factor includes glasses, a film, an LED, or an accessory.

5. The system for improving functional hearing according to claim 1, further comprising a remote microphone.

6. The system for improving functional hearing according to claim 5, wherein the at least one processor is further configured to execute instructions to:

receive a remote audio input from the remote microphone;

convert the remote audio input into a visual representation of the remote audio input; and transmit the visual representation of the remote audio input to at least one display.

7. The system for improving functional hearing according to claim 1, wherein the at least one processor is further configured to execute instructions to receive an audio input from a device.

8. The system for improving functional hearing according to claim 7, wherein the device includes at least one microphone, radio, TV, computer, cd player, tape player, cellular phone, smart phone, phone, PDA, musical equipment, game console, hearing aid, or streaming device.

9. The system for improving functional hearing according to claim 1, wherein the at least one processor is further configured to execute instructions to determine an accuracy score.

10. The system for improving functional hearing according to claim 1, wherein transmitting the visual representation to the at least one display comprises wireless transmission.

11. The system for improving functional hearing according to claim 1, wherein the visual representation comprises one or more of a hologram, a light wave, an image, a picture, a video, or text.

12. A method for improving functional hearing of a user, comprising:

receiving an audio input from a microphone positioned within an ear of the user;

amplifying the audio input;

outputting the amplified audio input from a speaker within the ear of the user;

converting the audio input into a visual representation of the audio input;

transmitting the visual representation to at least one display;

calibrating the visual representation; and training the user to recognize audio signals by correlating audio signals to the visual representation;

wherein calibrating the visual representation comprises, displaying an initial set of words or phrases;

prompting the presenter to make an audio input corresponding to the initial set of words or phrases;

recording and analyzing variables including one or more of inflection, pronunciation, and accent from the presenter created audio input;

providing a second set of words or phrases;

converting an audio input corresponding to each word or phrase of the second set to a visual representation based on variables recorded and analyzed from the initial set;

transmitting the visual representation to at least one display;

prompting the presenter to verify the accuracy of the visual representation of each word or phrase; and correcting the visual representation if a desired accuracy is not achieved.

13. The method for improving functional hearing of a user according to claim 12, wherein the at least one display comprises a mobile communications device.

14. The method for improving functional hearing of a user according to claim 12, wherein the at least one display comprises a wearable form factor.

15. The method for improving functional hearing of a user according to claim 14, wherein the wearable form factor includes glasses, a film, an LED, or an accessory.

16. The method for improving functional hearing of a user according to claim 12, further comprising:

receiving a remote audio input from a remote microphone;

amplifying the remote audio input;

outputting the amplified remote audio input from the speaker;

converting the remote audio input into a visual representation of the remote audio input; and transmitting the visual representation of the remote audio input to at least one display.

17. The method for improving functional hearing of a user according to claim 12, further comprising receiving an audio input from a device.

18. The method for improving functional hearing of a user according to claim 17, wherein the device includes at least one microphone, radio, TV, computer, cd player, tape player, cellular phone, smart phone, phone, PDA, musical equipment, game console, hearing aid, or streaming device.

19. The method for improving functional hearing of a user according to claim 12, wherein the at least one display is worn by the user.

20. The method for improving functional hearing of a user according to claim 12, further comprising wirelessly transmitting the visual representation.

21. The method for improving functional hearing of a user according to claim 12, wherein the visual representation comprises one or more of a hologram, a light wave, an image, a picture, a video, or text.

22. The method for improving functional hearing of a user according to claim 12, further comprising determining an accuracy score.

23. A system for improving functional hearing, comprising:

a housing configured to fit within an ear of a user, the housing comprising:

a speaker, an amplifier, a transmitter, and a power supply;

a memory storing instructions;

at least one processor configured to execute instructions to:

receive an audio input, amplify the audio input, output the amplified audio input from the speaker, convert the audio input into a visual representation of the audio input, and transmit the visual representation to at least one display;

at least one first training regimen configured to be used by a presenter to calibrate a visual representation system; and at least one second training regimen configured to be used by the user to recognize audio signals by correlating audio signals to the visual representation, wherein the at least one second training regimen comprises:

receiving an audio input of a list of predefined words or phrases outputting an amplified audio input from the speaker;

displaying a visual representation corresponding to the audio input;

prompting the user to indicate whether the audio signals are identical with the visual representation;

recording the user responses and generating an accuracy score accordingly;

determining one or more sets of words or phrases including certain sounds, phonemes, or other characteristics from based on the user indication; and outputting the audio input and visual representation of the determined one or more sets of words or phrases until a desired accuracy is achieved.

* * * * *